US010525700B2

(12) United States Patent
Hirokawa et al.

(10) Patent No.: US 10,525,700 B2
(45) Date of Patent: Jan. 7, 2020

(54) TRANSFER TYPE INK JET RECORDING METHOD AND TRANSFER TYPE INK JET RECORDING APPARATUS

(71) Applicant: CANON KABUSHIKI KAISHA, Tokyo (JP)

(72) Inventors: Ryosuke Hirokawa, Kawasaki (JP); Hiroaki Motooka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 15/432,999

(22) Filed: Feb. 15, 2017

(65) Prior Publication Data

US 2017/0232729 A1 Aug. 17, 2017

(30) Foreign Application Priority Data

Feb. 15, 2016 (JP) ..... 2016-026412

(51) Int. Cl.
*B41J 2/005* (2006.01)
*B41M 5/025* (2006.01)
*B41J 2/01* (2006.01)

(52) U.S. Cl.
CPC ..... *B41J 2/0057* (2013.01); *B41M 5/0256* (2013.01); *B41J 2002/012* (2013.01)

(58) Field of Classification Search
CPC . B41J 2/0057; B41J 2002/012; B41M 5/0256
See application file for complete search history.

(56) References Cited

U.S. PATENT DOCUMENTS 3,962,153 A 6/1976 Gore
5,841,456 A 11/1998 Takei et al.
2006/0164488 A1* 7/2006 Taniuchi ..... B41M 5/0256 347/103
2014/0370193 A1* 12/2014 Noguchi ..... B41M 5/0356 427/256

FOREIGN PATENT DOCUMENTS

JP S50-022881 A 3/1975
JP S56-45773 B2 10/1981
JP H05-200999 A 8/1993
JP 2010-241073 A 10/2010
JP 2010241073 * 10/2010 ..... B41J 2/01

* cited by examiner

*Primary Examiner* — Henok D Legesse
(74) *Attorney, Agent, or Firm* — Venable LLP

(57) ABSTRACT

A transfer type ink jet recording method including an image forming step of forming an image including an aqueous liquid component and a coloring material on an image forming surface of a transfer body, the image forming surface being formed of a water-repellent porous body; a transfer step of transferring the image from the transfer body onto a recording medium; a wetting treatment step of performing a wetting treatment by applying a wetting liquid whose contact angle with respect to the image forming surface is less than 90° onto the image forming surface before the image forming step; and a liquid absorbing step of absorbing at least part of the aqueous liquid component from the image formed in the image forming step by using the porous body in at least one of a period between the image forming step and the transfer step and a period in the transfer step.

23 Claims, 5 Drawing Sheets

TRANSFER TYPE INK JET RECORDING METHOD AND TRANSFER TYPE INK JET RECORDING APPARATUS

BACKGROUND OF THE INVENTION

Field of the Invention

The present invention relates to a transfer type ink jet recording method and a transfer type ink jet recording apparatus.

Description of the Related Art

In an ink jet recording technique, an image is formed by applying a liquid composition including a coloring material (ink) directly or indirectly onto a recording medium such as paper. At this time, curling or cockling occurs in some cases because of excessive absorption of a liquid component in the ink by the recording medium.

To prevent such a problem, there have been proposed techniques for quickly removing a liquid component in an ink from an image formed on a recording medium or a transfer body, such as a technique of drying a recording medium with warm air, infrared rays, or the like, and a technique of forming an image on a transfer body, drying a liquid component included in the image on the transfer body with thermal energy or the like, and then transferring the image onto a recording medium such as paper.

As a technique for increasing the efficiency in drying an image in the case of utilizing evaporation of a liquid component in the image to the air, Japanese Patent Application Laid-Open No. 2010-241073 discloses a transfer body having an image forming surface formed of a porous body obtained by biaxially stretching a polytetrafluoroethylene (PTFE) resin.

The image forming surface of the porous body disclosed in Japanese Patent Application Laid-Open No. 2010-241073 is formed in such a manner that the contact angle of a condensate used for image formation is 90° or more and the contact angle of an aqueous ink is less than 90°. This technique is intended to increase the efficiency in drying an image by forming the image by using a condensate and an aqueous ink on the transfer body having the image forming surface as described above.

In addition, to remove a liquid component included in an image, reduction of the amount of a liquid component included in the image by causing a transfer body to absorb the liquid component in the image has been studied. Japanese Patent Application Laid-Open No. H05-200999 discloses a configuration for removing a liquid component from an image by additionally using a decompression suction unit for a mesh filter made of a fluororesin constituting a transfer body surface.

SUMMARY OF THE INVENTION

The present invention is directed to provision of a transfer type ink jet recording method and a transfer type ink jet recording apparatus that can increase an efficiency of absorbing liquid components to a transfer body in absorbing the liquid components in the transfer body from an image formed on an image forming surface of the transfer body and can enhance releasability of a coloring material from the image forming surface of the transfer body.

In an aspect of the present invention, a transfer type ink jet recording method includes an image forming step of forming an image including an aqueous liquid component and a coloring material on an image forming surface of a transfer body, the image forming surface being formed of a water-repellent porous body; a transfer step of transferring the image from the transfer body onto a recording medium; a wetting treatment step of performing a wetting treatment by applying a wetting liquid whose contact angle with respect to the image forming surface is less than 90° onto the image forming surface before the image forming step; and a liquid absorbing step of absorbing at least a part of the aqueous liquid component by from the image formed in the image forming step using the porous body in at least one of a period between the image forming step and the transfer step and a period in the transfer step.

In another aspect of the present invention, a transfer type ink jet recording apparatus includes a transfer body having an image forming surface formed of a water-repellent porous body; an image forming unit configured to form an image including an aqueous liquid component and a coloring material on the image forming surface; a transfer unit configured to transfer the image from the transfer body onto a recording medium; a wetting liquid applying unit configured to perform a wetting treatment by applying a wetting liquid whose contact angle with respect to the image forming surface is less than 90° onto the image forming surface; a conveyance unit configured to relatively move the transfer body with respect to the wetting liquid applying unit, the image forming unit and the transfer unit in this order; and a liquid absorbing unit configured to absorb at least a part of the aqueous liquid component from an image formed by the image forming unit by using the porous body.

In yet another aspect of the present invention, a transfer type ink jet recording method includes an image forming step of forming an image including an aqueous liquid component and a coloring material on an image forming surface of a transfer body, the image forming surface being formed of a water-repellent porous body; a transfer step of transferring the image from the transfer body onto a recording medium; a wetting treatment step of performing a wetting treatment by applying a wetting liquid whose contact angle with respect to the image forming surface is less than 90° onto the image forming surface before the image forming step; and a liquid absorbing step of absorbing at least a part of the aqueous liquid component from an image formed in the image forming step by using the porous body in at least one of a period between the image forming step and the transfer step and a period in the transfer step.

In still another aspect of the present invention, a transfer type ink jet recording apparatus includes a transfer body having an image forming surface formed of a water-repellent porous body; an image forming unit configured to form an image including an aqueous liquid component and a coloring material on the image forming surface; a transfer unit configured to transfer the image from the transfer body onto a recording medium; a wetting liquid applying unit configured to perform a wetting treatment by applying a wetting liquid whose contact angle with respect to the image forming surface is less than 90° onto the image forming surface; a conveyance unit configured to relatively move the transfer body with respect to the wetting liquid applying unit, the image forming unit, and the transfer unit in this order; and a liquid absorbing unit configured to absorb at least a part of the aqueous liquid component by using the porous body from an image formed by the image forming unit so that an ink constituting the image is concentrated.

Further features of the present invention will become apparent from the following description of exemplary embodiments with reference to the attached drawings.

DESCRIPTION OF THE EMBODIMENTS

Figure 1:
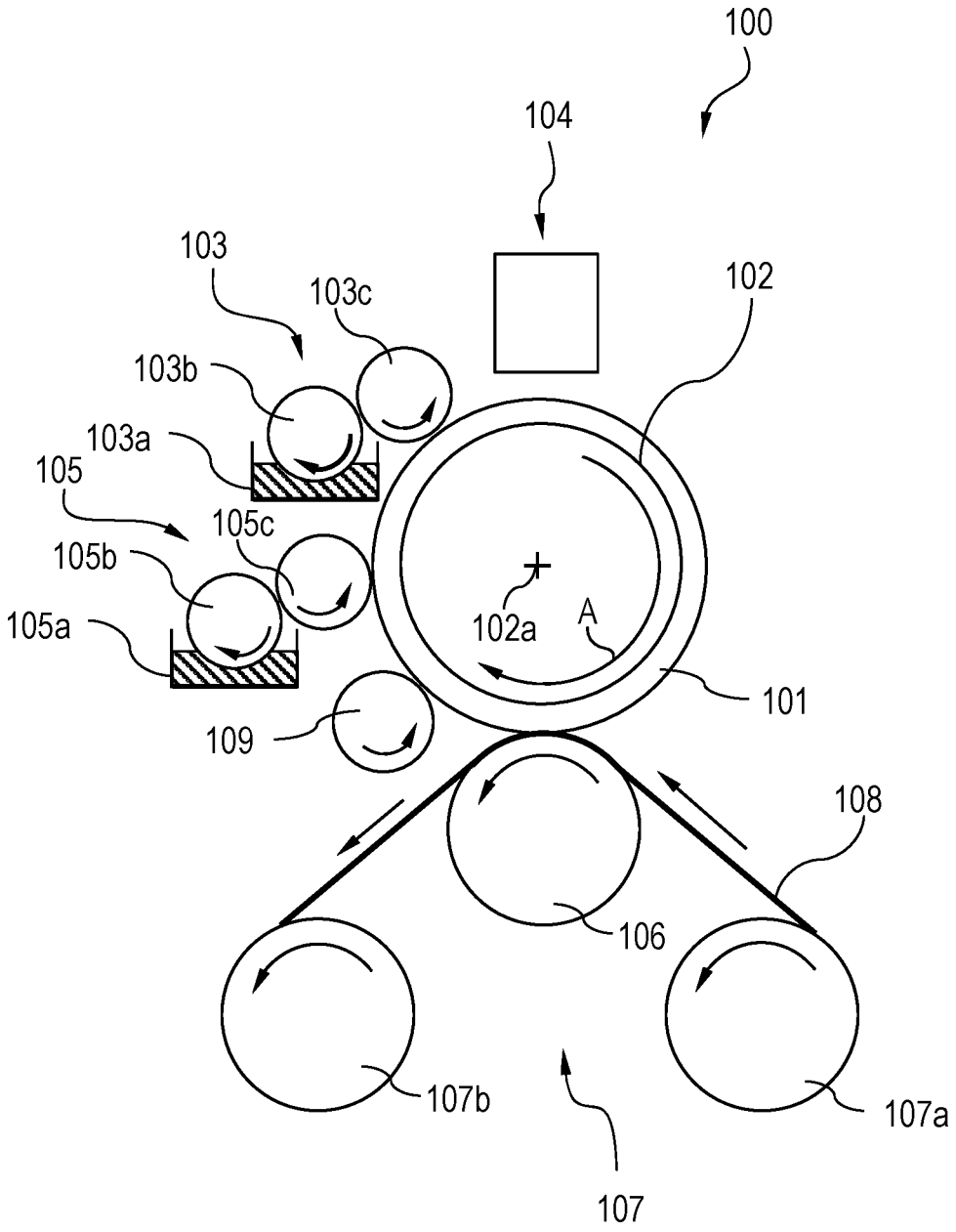
FIG. 1 schematically illustrates an example configuration of a transfer type ink jet recording apparatus according to the present invention including a wetting liquid applying unit and a reaction liquid applying unit.

Preferred embodiment of the present invention will now be described in detail in accordance with the accompanying drawings.

In Japanese Patent Application Laid-Open No. H05-200999, a liquid component is removed from an image formed on a transfer body by using a decompression suction unit for a mesh filter made of a fluororesin constituting a surface of the transfer body. Thus, in the configuration disclosed in Japanese Patent Application Laid-Open No. H05-200999, the filter of a fluororesin having releasability for a coloring material is used together with the decompression suction unit so that an efficiency in removing a liquid component from an image is expected to be further enhanced while preventing coloring material adhesion to the filter.

Depending on properties of the fluororesin constituting the filter, however, permeability of a liquid component to be removed from an image through the filter is insufficient so that the efficiency in removing the liquid component from the image by absorption cannot be enhanced.

A transfer type ink jet recording method according to the present invention includes:

(1) an image forming step of forming an image including an aqueous liquid component and a coloring material on a surface of a transfer body formed of a porous body on which an image is to be formed, that is, an image forming surface of the porous body;

(2) a transfer step of transferring an image from the transfer body onto a recording medium;

(3) a wetting treatment step of performing a wetting treatment by applying a wetting liquid whose contact angle with respect to the image forming surface is less than 90° onto the image forming surface before the image forming step; and (4) a liquid absorbing step of absorbing at least a part of the aqueous liquid component from the image formed in the image forming step by using the porous body before or in the transfer step.

The application of the ink including the coloring material (second liquid composition) onto the image forming surface of the transfer body is performed by an ink jet method.

The transfer body has an image forming surface of a water-repellent porous body. The water-repellent porous body herein refers to a porous body whose contact angle with water is 90° or more. The use of the water-repellent porous body can enhance releasability for a coloring material (especially a pigment).

Formation of the image on the transfer body is preferably performed by applying, onto the transfer body, a first liquid composition for enhancing fixation of the coloring material included in the second liquid composition applied onto the transfer body and a second liquid composition including an aqueous liquid medium and a coloring material. As the second liquid composition, an aqueous pigment ink including at least a pigment as a coloring material is preferably used. The second liquid composition is applied onto the transfer body by an ink jet method.

The first liquid composition may also serve as a wetting liquid by including therein an aqueous liquid medium functioning as a wetting liquid for wetting the image forming surface of the transfer body.

Preferably, in the ink jet recording apparatus according to the present invention, a wetting treatment region where the wetting liquid applying step is performed, an image forming region where the image forming step is performed, and a transfer region where the transfer step is performed are provided, and the transfer body is caused to move by a conveying device relative to these regions so that the steps for these regions are sequentially performed. For example, the wetting treatment region, the image forming region, and the transfer region may be arranged in this order from an upstream side to a downstream side in the direction in which the transfer body relatively moves with respect to these regions so that the steps in these regions are performed.

An ink jet recording apparatus for use in an ink jet recording method according to the present invention includes:

(I) a transfer body having an image forming surface constituted by a water-repellent porous body;

(II) an image forming unit configured to form an image including an aqueous liquid component and a coloring material on the image forming surface of a transfer body;

(III) a transfer unit configured to transfer the image from the transfer body onto a recording medium;

(IV) a wetting liquid applying unit configured to apply a wetting liquid whose contact angle with respect to the image forming surface is less than 90° onto the image forming surface; and (V) a conveyance unit configured to relatively move the transfer body with respect to the wetting liquid applying unit the image forming unit, and the transfer unit in this order.

The application of the ink including the coloring material onto the image forming surface of the transfer body is performed by an ink jet method.

The transfer body has an image forming surface formed of the water-repellent porous body.

The image forming unit preferably includes a first liquid applying unit configured to apply, onto the transfer body, a first liquid composition for enhancing fixation of the coloring material applied onto the transfer body and a second liquid applying unit configured to apply a second liquid composition including an aqueous liquid medium and a coloring material onto the transfer body by an ink jet method. As the second liquid composition, an aqueous pigment ink including at least a pigment as a coloring material is preferably used.

With the arrangement of the units described above, the wetting liquid applying step is performed by the wetting liquid applying unit before the image forming step is performed by the image forming unit.

The first liquid applying unit may also serve as a wetting liquid applying unit by including therein an aqueous liquid medium functioning as a wetting liquid so that the first liquid composition is used as the wetting liquid.

The transfer body is caused to relatively move by the conveying device with respect to the wetting treatment region for the step performed by the wetting liquid applying unit, the image forming region for the step performed by the image forming unit, and the transfer region for the step performed by the transfer unit, so that these steps in these regions are sequentially performed. For example, the wetting treatment region, the image forming region, and the transfer region may be arranged in series in this order from an upstream side to a downstream side in the direction in which the transfer body relatively moves with respect to these regions so that these steps for the regions are performed.

In the present invention, the image forming surface of the transfer body is preferably formed of a water-repellent porous body serving as a liquid absorbing member configured to absorb at least a part of an aqueous liquid component from an image including the aqueous liquid component and a coloring material. The use of the water-repellent porous body as the image forming surface of the transfer body enables the image forming surface to have releasability for the coloring material included in the ink. As a result, when forming an image on the image forming surface, performing a liquid absorbing treatment from the image, and then transferring the image, coloring material adhesion to the image forming surface or coloring material removal from the image can be effectively prevented.

In addition, the image forming surface of the porous body is processed by using the wetting liquid so that even when the image forming surface is water-repellent, a region impregnated with the wetting liquid has high wettability with respect to the aqueous liquid component included in the image. As a result, an efficient liquid absorbing treatment from the image can be performed with the water-repellent porous body.

In the ink jet recording apparatus according to the present invention, the image forming unit is not specifically limited as long as an image including an aqueous liquid component and a coloring material can be formed on the transfer body.

The image forming unit preferably includes:

(1) a device constituting a first liquid applying unit configured to apply a first liquid composition onto the transfer body; and (2) a device constituting a second liquid applying unit configured to apply a second liquid composition including an aqueous liquid medium and a coloring material onto a transfer body.

The image to be subjected to a liquid absorbing treatment is preferably formed by applying the first liquid composition and the second liquid composition onto the transfer body so as to have a region where at least the first and second liquid compositions overlap with each other. Namely, the second liquid composition is applied onto the transfer body so that the second liquid composition overlaps with at least a region on which the first liquid composition is preferably applied. The combined use of the first liquid composition increases fixation of the coloring material applied onto the transfer body with the second liquid composition. This increase of fixation of the coloring material refers to a phenomenon that the fluidity of the second liquid composition itself or a coloring material in the second liquid composition decreases by an action of the first liquid composition to result in a state in which the second liquid composition does not easily flow from an initial state in which the second liquid composition applied onto the transfer body has fluidity. This mechanism will be described later.

As described above, the image formed on the transfer body preferably includes a mixture of the first and second liquid compositions. The second liquid composition includes an aqueous liquid medium including water, and when necessary, the first liquid composition also includes an aqueous liquid medium including water. The image obtained from these liquid compositions includes an aqueous liquid component including water supplied from the aqueous liquid media, together with the coloring material.

Typically, the second liquid composition is an ink including a coloring material, and the device configured to apply the second liquid composition onto the transfer body is an ink jet recording device. The first liquid composition can include a component that chemically or physically acts with the second liquid composition so that the mixture of the first and second liquid compositions has a viscosity higher than that of each of the first and second liquid compositions and, thereby, increases fixation of the coloring material. The first liquid composition can further include an aqueous liquid medium. The aqueous liquid medium includes at least water and may include an aqueous organic solvent or various additives as necessary. In a case where water is a first liquid, at least one of the first liquid composition and the second liquid composition can include a second liquid that is a liquid except the first liquid. The second liquid may have any volatility but preferably has a volatility higher than that of the first liquid.

An embodiment of the present invention will now be described.

In the following description, "reaction liquid" is used as the first liquid composition, and "reaction liquid applying device" is used as the first liquid applying unit, "ink" is used as the second liquid composition, "ink applying device" is used as the second liquid applying unit, and "wetting liquid applying device" is used as the wetting liquid applying unit. The first image refers to an ink image before liquid removal that is not yet subjected to a liquid absorbing treatment. The second image refers to an ink image after liquid removal that has been subjected to the liquid absorbing treatment so that the content of an aqueous liquid component is reduced.

Reaction Liquid Applying Device

The reaction liquid applying device may be any device that can apply a reaction liquid onto a transfer body, and various known devices may be used as appropriate. Specifically, examples of the reaction liquid applying device include a gravure offset roller, an ink jet head, a die coating device (die coater), and a blade coating device (blade coater). The application of the reaction liquid by the reaction liquid applying device may be performed before application of an ink or after application of the ink as long as the reaction liquid can be mixed (react) with the ink on a transfer body. Preferably, the reaction liquid is applied before application of the ink. The application of the reaction liquid before application of the ink can suppress bleeding in which adjacently applied inks are mixed or beading in which a previously impacting ink is attracted to a subsequently impacting ink, in image recording by an ink jet technique.

Reaction Liquid

The reaction liquid includes a component that increases the viscosity of ink (ink-viscosity-increasing component).

The increase of ink viscosity here refers to a phenomenon that components constituting the ink, such as a coloring material and a resin, comes into contact with the ink-viscosity-increasing component to cause chemical reaction therewith or physically adsorption thereonto, so that an increase of the viscosity of the ink is observed.

This increase of the ink viscosity includes not only a case where an increase of the ink viscosity is observed but also a case where the viscosity locally increases because of aggregation of some of components constituting the ink such as a coloring material and a resin.

The ink-viscosity-increasing component has an effect of reducing fluidity of the ink and/or some of components constituting the ink on a transfer body to suppress bleeding or beading in forming an image on the transfer body. In the present invention, the increase of the ink viscosity will also be hereinafter referred to as "viscously thickening the ink." As such an ink-viscosity-increasing component, known materials such as polyvalent metal ions, organic acids, cationic polymers, and porous fine particles may be used. In particular, polyvalent metal ions and organic acids are preferably used. A plurality of types of ink-viscosity-increasing components may be preferably included. The content of the ink-viscosity-increasing component in the reaction liquid is preferably 5 mass % or more of the total mass of the reaction liquid.

Examples of the polyvalent metal ions include divalent metal ions such as $Ca^{2+}$, $Cu^{2+}$, $Ni^{2+}$, $Mg^{2+}$, $Sr^{2+}$, $Ba^{2+}$, and $Zn^{2+}$ and trivalent metal ions such as $Fe^{3+}$, $Cr^{3+}$, $Y^{3+}$, and $Al^{3+}$.

Examples of the organic acids include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, oxysuccinic acid, and dioxysuccinic acid.

The reaction liquid may include appropriate amounts of water and a low-volatile organic solvent, as the aqueous liquid medium. Water used in this case is preferably water deionized by ion exchange or the like. The organic solvent that can be used for the reaction liquid applicable to the present invention is not specifically limited, and any known organic solvent may be used.

In using the reaction liquid, the surface tension or the viscosity of the reaction liquid is adjusted as necessary by adding a surfactant or a viscosity modifier. Any material that can coexist with the ink-viscosity-increasing component may be used. Specific examples of the surfactant include fluorine-based surfactants such as an acetylene glycol ethylene oxide adduct (trade name: "Acetylenol E100" manufactured by Kawaken Fine Chemicals Co., Ltd.) and perfluoroalkyl ethylene oxide adducts (e.g., trade name: "Megafac F444" manufactured by DIC Corporation, trade name: "Capstone FS-3100" manufactured by The Chemours Company LLC, and trade name: "Zonyl FS3100" manufactured by du Pont Co.) and silicone-based surfactants such as a polyether-modified polydimethylsiloxane adduct (trade name: "BYK349" manufactured by BYK Japan KK).

The reaction liquid may be used as a wetting liquid. In this case, the composition of the reaction liquid is adjusted so that the contact angle of the reaction liquid with respect to an image forming surface of a water-repellent porous body is less than 90°. The contact angle of the reaction liquid can be adjusted by selecting the type or amount of a surfactant to be added to the reaction liquid.

Ink Applying Device

As an ink applying device configured to apply an ink, an ink jet head is used. The ink jet head may be of a type that discharges an ink by causing film boiling in the ink by an electrothermal converter and, thereby, forms bubbles, a type that discharges an ink with an electromechanical converter, or a type that discharges an ink by using static electricity. In the present invention, a known ink jet head may be used. In particular, from the viewpoint of printing at high speed with high density, the type that uses an electrothermal converter is preferably used. In image formation, an image signal is received, and an ink in an amount necessary for each location is applied.

The amount of ink application can be expressed as an image density (duty) or an ink thickness, and in the present invention, the amount of ink application ($g/m^2$) is expressed as an average value obtained by multiplying the mass of each ink dot by the number of applied dots followed by being divided by a printed area. A maximum amount of ink applied on an image region refers to the amount of ink applied on at least an area of 5 $mm^2$ or more in a region used as information of a transfer body, from the viewpoint of removing liquid components of the ink.

The ink jet recording apparatus according to the present invention may include a plurality of ink jet heads in order to apply inks of colors on the transfer body. In the case of forming color images using a yellow ink, a magenta ink, a cyan ink, and a black ink, for example, the ink jet recording apparatus includes four ink jet heads that respectively discharge the four types of inks onto the transfer body.

The ink applying apparatus may include an ink jet head that discharges an ink including no coloring materials (clear ink).

Ink

Components of an ink applied to the present invention will be described.

Coloring Material

As a coloring material included in the ink applied to the present invention, a pigment or a mixture of a pigment and a dye may be used. The pigment that can be used as a coloring material is not specifically limited. Specific examples of the pigment include inorganic pigments such as carbon black; and organic pigments such as an azo-based pigment, a phthalocyanine-based pigment, a quinacridone-based pigment, an isoindolinone-based pigment, an imidazolone-based pigment, a diketo-pyrrolo-pyrrole-based pigment, and a dioxazine-based pigment. These pigments may be used singly or two or more of the pigments may be used in combination.

The dye that can be used as a coloring material is not specifically limited. Specific examples of the dye include a direct dye, an acid dye, a basic dye, a disperse dye, and a food dye, and a die having an anionic group may also be used. Specific examples of a dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5 mass % or more to 15.0 mass % or less, and more preferably 1.0 mass % or more to 10.0 mass % or less, of the total mass of the ink.

Dispersant

As a dispersant for dispersing a pigment, a known dispersant for an ink jet ink may be used. In particular, in an aspect of the present invention, a water-soluble dispersant having a hydrophilic part and a water-repellent part in its structure is preferably used. In particular, a pigment dispersant formed of a copolymerized resin including at least a hydrophilic monomer and a water-repellent monomer is preferably used. The monomers used here are not limited to specific types, and known monomers are preferably used. Specific examples of the water-repellent monomer include styrene and other styrene derivatives, alkyl(meth)acrylate, and benzyl(meth)acrylate. Examples of the hydrophilic monomer include acrylic acid, methacrylic acid, and maleic acid.

The dispersant preferably has an acid value of 50 mgKOH/g or more to 550 mgKOH/g or less. The dispersant preferably has a weight-average molecular weight of 1000 or more to 50000 or less. The mass ratio of the pigment to the dispersant (pigment:dispersant) is preferably in the range from 1:0.1 to 1:3.

It is also preferable in the present invention to replace the dispersant with a so-called self-dispersible pigment in which the surface of the pigment itself is modified so that the pigment can be dispersed.

Resin Fine Particles

The ink applied to the present invention can be used while containing various types of fine particles including no coloring materials. In particular, resin fine particles are preferably used because the resin fine particles can effectively enhance image quality or fixation. The material of the resin fine particles applicable to the present invention is not specifically limited, and any known resin may be used as appropriate. Specific examples of such a resin include homopolymers such as polyolefin, polystyrene, polyurethane, polyester, polyether, polyurea, polyamide, polyvinyl alcohol, poly(meth)acrylic acid and a salt thereof, poly (meth)acrylic acid alkyl, and polydiene, and copolymers obtainable by polymerizing a plurality of types of monomers for producing these monopolymers. The resin preferably has a weight-average molecular weight (Mw) of 1,000 or more to 2,000,000 or less. The amount of resin fine particles in the ink is preferably 1 mass % or more to 50 mass % or less, and more preferably 2 mass % or more to 40 mass % or less, of the total mass of the ink.

In an aspect of the present invention, the resin fine particles are preferably used as a resin fine particle dispersion in which the resin fine particles are dispersed in a liquid. The dispersion technique is not specifically limited, and a so-called self-dispersing type resin fine particle dispersion in which particles are dispersed by using a resin obtained by homopolymerizing or copolymerizing one or more types of monomers having a dissociable group is preferably employed. Examples of the dissociable group include a carboxyl group, a sulfonic acid, and a phosphoric acid. Examples of the monomer having such a dissociable group include acrylic acid and methacrylic acid. Similarly, a so-called emulsion-dispersion type resin fine particle dispersion in which resin fine particles are dispersed by an emulsifier is also preferably used in the present invention. The emulsifier here is preferably a known surfactant, irrespective of whether the molecular weight of the surfactant is low or high. The surfactant is preferably a nonionic surfactant or a surfactant having the same charge as that of resin fine particles.

The resin fine particle dispersion used in an aspect of the present invention preferably has a dispersed particle size of 10 nm or more to 1000 nm or less, and more preferably has a dispersed particle size of 100 nm or more to 500 nm or less.

In producing the resin fine particle dispersion for use in an aspect of the present invention, various types of additives are preferably added for stability. Examples of the additives include n-hexadecane, dodecyl methacrylate, stearyl methacrylate, chlorobenzene, dodecylmercaptan, a blue dye (bluing agent), and polymethyl methacrylate.

Curing Component

In the present invention, the reaction liquid or the ink preferably includes a component that is cured with activation energy rays. Curing of a component that is cured with activation energy rays before a liquid absorbing process can enhance releasability (transferability) from the image forming surface of the porous transfer body.

As the component that is cured by application of activation energy rays for use in the present invention, a component that is cured by application of activation energy rays to be more insoluble than before the application is used. As an example of such a component, a typical ultraviolet curable resin may be used. Many ultraviolet curable resins are not water-soluble. A material applicable to a water-based ink that is preferably used in the present invention, however, preferably includes, in its structure, at least an ethylenic unsaturated bond curable with ultraviolet rays and has a hydrophilic linking group. Examples of the hydrophilic linking group include a hydroxyl group, a carboxyl group, a phosphate group, a sulfonic group, salts of these groups, an ether linkage, and an amide linkage. The curable component used in the present invention is preferably hydrophilic. Examples of the activation energy rays include ultraviolet rays, infrared rays, and electron rays.

In the present invention, any one of the reaction liquid and the ink preferably includes a polymerization initiator. The polymerization initiator used in the present invention may be any compound that generates radicals upon application of activation energy rays.

To enhance a reaction rate, a sensitizing agent that increases an absorption wavelength of light may also be used, which is a very preferable embodiment.

Surfactant

An ink that can be used in the present invention may include a surfactant. Specific examples of the surfactant include an acetylene glycol ethylene oxide adduct (Acetylenol E100, manufactured by Kawaken Fine Chemicals Co., Ltd.). The amount of the surfactant in the ink is preferably 0.01 mass % or more to 5.0 mass % or less of the total mass of the ink.

Water and Water-Soluble Organic Solvent

The aqueous liquid medium of the ink is a liquid medium including at least water. As the ink including the aqueous liquid medium, that is, an aqueous ink, an aqueous pigment ink including at least a pigment as a coloring material can be used.

The aqueous liquid medium may further include an aqueous organic solvent as necessary. Water used in this case is preferably water deionized by ion exchange or the like. The content of water in the ink is preferably 30 mass % or more to 97 mass % or less of the total mass of the ink.

The water-soluble organic solvent used in the present invention is not specifically limited, and any known organic solvent may be used. Specific examples of the organic solvent include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Two or more of these organic solvents may be used in combination, of course.

The content of the water-soluble organic solvent in the ink is preferably 3 mass % or more to 70 mass % or less of the total mass of the ink.

Other Additives

An ink that can be used in the present invention may contain various additives, as necessary, such as a pH adjuster, a rust preventive, an antiseptic agent, a mildew proofing agent, an oxidation inhibitor, an antireduction agent, a water-soluble resin, a neutralizer for a water-soluble resin, and a viscosity modifier, in addition to the components described above. The amount of the ink is preferably 50 mass % or more to 95 mass % or less.

Transfer Body

The transfer body applied to the present invention has the function of absorbing at least a part of an aqueous liquid component by using a porous body constituting an image forming surface of the transfer body from an image formed on the image forming surface and, thereby, reducing the content of liquid components in the image.

The porous body constituting the image forming surface of the transfer body in the present invention is water-repellent in order to reduce affinity for the coloring material included in the image (i.e., to enhance releasability of the coloring material) and to increase transferability of an image after liquid removal to a recording medium. In the water-repellent porous body, the contact angle with water is preferably 90° or more. The inventors of the present invention intensively studied to find that the use of the porous body whose contact angle with water is 90° or more can enhance releasability (transferability) of the porous body and the image. The contact angle herein refers to an angle formed by a surface of a target and a droplet of a measurement liquid (e.g., water or a wetting liquid) which is dropped on the target (i.e., the image forming surface of the porous body) at the contact part where the droplet is in contact with the target. There are several types of measurement techniques, and inventors of the present invention measured the contact angle for the image forming surface of the porous body in conformity with a technique described in "6. Sessile Drop Method" defined in JIS R3257. Water used as a liquid for the measurement is pure water (distilled water).

The material of the porous body is not limited to a specific material as long as a surface (image forming surface) whose contact angle with water is 90° or more can be formed, and is preferably a fluororesin. Specific examples of the fluororesin include polytetrafluoroethylene (hereinafter referred to as PTFE), polychlorotrifluoroethylene (PCTFE), polyvinylidene fluoride (PVDF), polyvinyl fluoride (PVF), perfluoro-alkoxyfluoro resin (PFA), tetrafluoroethylene-hexafluoropropylene copolymer (FEP), ethylene-tetrafluoroethylene copolymer (ETFE), and ethylene-chlorotrifluoroethylene copolymer (ECTFE). One or more of these materials may be used as necessary, and a plurality of films of these resins may be laminated. Among these resins, polytetrafluoroethylene is preferable. The porous body is preferably formed by using a water-repellent resin material including polytetrafluoroethylene.

The contact angle of water for a surface of the porous body to be the image forming surface may be adjusted by performing a known water repellent treatment on this surface, as necessary.

To enhance releasability (transferability) of an image, the porous body used for forming the image forming surface of the transfer body preferably has a small pore diameter, and the pore diameter of the porous body at least at the surface on which the image is to be formed, that is, at the image forming surface of the porous body, is preferably 10 μm or less. To enhance absorbency of a liquid component into the porous transfer body, the pore diameter of the porous body at the image forming surface is preferably 0.05 μm or more.

The pore diameter herein refers to an average diameter, and can be measured by a known method such as mercury intrusion porosimetry, nitrogen adsorption, or SEM image analysis.

To obtain a uniformly high air permeability, the porous body preferably has a small thickness. The thickness of the porous body is preferably 50 μm or less, and more preferably 30 μm or less. From the viewpoint of strength and operability in a case where the porous body is a single layer, the thickness of the porous body is preferably 1 μm or more. The air permeability can be represented by a Gurley value defined in JIS P8117, and the Gurley value is preferably 10 seconds or less. The lower limit of the Gurley value is not limited to a specific value, and may be 0.1 second or more, for example. The transfer body is not specifically limited, and may have a sheet shape, a roller shape, a belt shape, an endless web shape, or other shapes.

A thin porous body having a single-layer structure might fail to obtain a capacity sufficient for absorbing a liquid component, and thus, the porous body can have a multilayer structure. In the transfer body, only a layer on which an image is formed needs to be a porous body, and a layer that does not contact with the image on the transfer body does not need to be a porous body.

A method for producing the porous body is not specifically limited, and a method that has been widely used to date may be used. Examples of the method include a method for producing a porous body by biaxially stretching a resin including polytetrafluoroethylene described in Japanese Patent No. 1114482.

Multilayer Structure of Porous Body

An embodiment in a case where a porous body has a multilayer structure will now be described. In the following description, a layer including an image forming surface is a first layer, and a layer that is laminated on a surface opposite to the image forming surface of the first layer is defined as a second layer. Layers constituting the multilayer structure will be sequentially described from the first layer in the order of lamination. In this specification, the first layer will also be referred to as "absorption layer" and a layer including the second and subsequent layers will also be referred to as "support layer."

First Layer

To enhance transferability and cleanability, the water-repellent porous body described above is preferably used for the first layer. As a resin material for the porous body serving as the first layer, one or more materials may be used as necessary. The first layer may have a structure in which a plurality of films are laminated.

A water-repellent material hardly sucks a liquid by a capillary force, and it takes time to suck a liquid when the material first contacts an image. For this reason, the first layer is preferably impregnated with a wetting liquid whose contact angle with respect to the image forming surface is less than 90°. The first layer can be impregnated with the wetting liquid by applying the wetting liquid by a coating method or the like. The wetting liquid is preferably prepared by mixing a liquid medium containing water with a surfactant or a liquid having a low contact angle for the first layer. The wetting liquid permeated in the porous body is gradually replaced by an aqueous liquid component absorbed from the image, and thus, the absorption efficiency of the first layer can gradually decrease in some cases. Thus, the wetting liquid is preferably applied onto the image forming surface of the first layer by applying the wetting liquid every predetermined number of times.

As described above, a reaction liquid can be used as the wetting liquid by adjusting the composition of the reaction liquid in such a manner that the contact angle of the reaction liquid with respect to the image forming surface of the first layer is less than 90°. In this case, the contact angle of the reaction liquid can be adjusted by mixing the reaction liquid with a liquid whose contact angle with respect to a surfactant or the image forming surface is small.

The thickness of the first layer is preferably 50 μm or less, more preferably 30 μm or less, and much more preferably 1 μm or more to 30 μm or less. It is preferable to use a porous body having such a thickness that can obtain a uniformly high air permeability by adjusting the thickness of the first layer as described above.

In examples of the present invention, the thickness was measured at ten arbitrary points with a non-rotating spindle type micrometer OMV_25 (manufactured by Mitutoyo Corporation) and calculating an average value.

The first layer can be produced by a known method for producing a thin porous film. For example, the thin porous film can be obtained by obtaining a sheet of a resin material with a method such as extrusion molding and then drawing the sheet to a predetermined thickness. A porous film can also be obtained by adding a plasticizer such as paraffin to a material for extrusion molding and removing the plasticizer by heating or the like during drawing. The pore diameter can be adjusted by appropriately adjusting the addition amount of the plasticizer, the draw ratio, and so on.

Second Layer

In the present invention, the second layer is preferably an air-permeable layer. Such a layer may be a nonwoven fabric of resin fibers or a woven fabric. The material of the second layer is not limited to a specific material, and is preferably a material whose contact angle with an aqueous liquid component absorbed from an image is substantially equal or less than a contact angle with respect to the first layer so that a liquid absorbed in the first layer does not flow back. Specific examples of the material include polyolefin (e.g., polyethylene (PE), polypropylene (PP)), polyurethane, nylon, polyamide, polyester (e.g., polyethylene terephthalate (PET)), a single material such as polysulfone (PSF), and a composite material of at least two of these materials. The second layer preferably has a pore diameter larger than that of the first layer.

Third Layer

In the present invention, a porous body having a multilayer structure may include three or more layers. The third layer (also referred to as a third layer) and subsequent layers are preferably nonwoven fabrics, from the viewpoint of rigidity. A material similar to those for the second layer can be used.

The thickness of a layer provided on the first layer can be set in accordance with the function required for the layer. For example, in a case where the second layer and the third layer are required of having liquid storage capacities, these layers are formed to have thicknesses sufficient for obtaining the liquid storage capacities.

Other Materials

In addition to the porous body having the lamination structure described above, the transfer body may include a reinforcing member for reinforcing a side surface of the transfer body. The transfer body may include a joint member in joining longitudinal ends of a long sheet-shaped porous body together to form a belt-shaped member. As such a material, a non-porous tape material or the like may be used, and may be disposed at a position or in a cycle at which the material does not contact an image.

Method for Producing Porous Body

The method for forming a porous body by laminating a first layer and a second layer is not specifically limited. The layers may be simply overlaid with each other or may be bonded together by lamination with an adhesive agent or lamination with heating. From the viewpoint of air permeability, the lamination with heating is preferable in the present invention. For example, the first layer and the second layer may be partially melted to be laminated and bonded together by heating. Alternatively, a welding material such as a hot-melt powder may be interposed between the first layer and the second layer to bond and laminate the first and second layers by heating. In the case of laminating the third and subsequent layers, these layers may be laminated at a time, or may be sequentially laminated. The order of the lamination may be selected as appropriate.

In the heating process, a lamination method of heating a porous body while pressing the porous body with heated rollers is preferable.

Wetting Liquid

The contact angle of the wetting liquid with respect to the image forming surface of the transfer body constituted by the porous body is less than 90°. The composition of the wetting liquid is not specifically limited as long as the transfer body can obtain an intended liquid absorbency. Specifically, the wetting liquid preferably contains an aqueous liquid medium which is a medium containing at least water and a component that adjusts the surface tension of the wetting liquid. The material used for adjusting the contact angle of the wetting liquid is not specifically limited, and a surfactant is preferably used. As the surfactant, at least one of a silicone-based surfactant and a fluorine-based surfactant is preferably used, and a fluorine-based surfactant is more preferably used. Examples of the surfactant to be used include fluorine-based surfactants such as F-444 (trade name, manufactured by DIC Corporation), Zonyl FS3100 (trade name, manufactured by E. I. du Pont de Nemours and Company), and Capstone FS-3100 (trade name, manufactured by The Chemours Company LLC) and silicone-based surfactants such as BYK349 (trade name, manufactured by BYK Japan KK). Water used in this case is preferably water deionized by ion exchange or the like. The water-soluble organic solvent is not specifically limited, and any known organic solvent such as ethanol or isopropyl alcohol may be used.

A method for applying the wetting liquid may be an immersion method, a coating method, a liquid drop method, or other methods, and is not limited to a specific method. To apply the wetting liquid stably or at high speed in the apparatus, a coating method using roller pressing is preferably used. The location on which the wetting liquid is applied is that before image formation on the transfer body. The timing of applying the wetting liquid is not specifically limited. In the case of performing a wetting treatment with the wetting liquid by rotatably driving a drum-shaped or an endless web-shaped transfer body, the timing of applying the wetting liquid may be controlled as appropriate in such a manner that the wetting liquid is applied at each rotation or once in several rotations, for example. The wetting liquid applying device is configured to move up and down by using a motor, a cam mechanism, or an air cylinder so that the wetting liquid applying device can removably contact with the transfer body.

The amount of application of the wetting liquid to the transfer body may be an amount that can enhance absorbency of a liquid component from an image formed on the transfer body by an image forming unit, and is preferably selected to be 0.2 g/cm$^2$ or more.

Transfer Type Ink Jet Recording Apparatus

FIG. 1 schematically illustrates an example configuration of a transfer type ink jet recording apparatus according to an embodiment of the invention.

A transfer type ink jet recording apparatus 100 includes a porous transfer body 101 to temporarily hold an image (first image) before liquid removal formed on an image forming surface of a transfer body and an image (second image) after liquid removal of removing at least some portions of aqueous liquid components from the first image. The transfer type ink jet recording apparatus 100 also includes a transfer unit including a pressing member 106 for transfer (hereinafter referred to as a transfer pressing member) to transfer the second image onto a recording medium 108 on which an image is to be formed, that is, a recording medium to form a final image in accordance with an intended application.

The transfer type ink jet recording apparatus 100 according to the present invention includes the endless web-shaped transfer body 101 supported by a support member 102; a reaction liquid applying device 103 configured to apply a reaction liquid onto the transfer body 101 along the outer periphery of the transfer body 101; an ink applying device 104 configured to apply an ink onto the transfer body 101 provided with the reaction liquid to form an ink image (first image) on the transfer body 101; and the pressing member 106 configured to transfer a second image on the transfer body from which the liquid component has been removed onto the recording medium 108 such as paper by pressing the recording medium. The transfer type ink jet recording apparatus 100 may further include a transfer body cleaning member 109 to clean a surface of the transfer body 101 onto which the second image has been transferred.

The support member 102 rotates about a rotation axis 102*a* in a direction indicated by the arrow in FIG. 1. This rotation enables movement of the transfer body 101 relative to other members. The illustrated ink jet recording apparatus includes, as a conveying device for conveying the transfer body, a conveying device (not shown) including a driving shaft and a driving motor for rotating and driving the transfer body. In addition, in the illustrated ink jet recording apparatus, each member is fixed, and rotation of the transfer body 101 causes the image forming surface at the outer periphery of the transfer body 101 to move relative to other members. The wetting liquid applying device 105 and the image forming unit including the reaction liquid applying device 103 and the ink applying device 104 are disposed from an upstream side to a downstream side in the direction in which the image forming surface moves. A wetting liquid is applied from the wetting liquid applying device 105 onto an image forming surface of the moving transfer body 101. Thereafter, a reaction liquid from the reaction liquid applying device 103 and an ink from the ink applying device 104 are sequentially applied, thereby forming a first image on the transfer body 101.

The first image is formed on the porous body constituting the image forming surface of the transfer body 101 and temporarily contacts with the porous body. During this contact, the porous body of the transfer body 101 removes a liquid component from the first image. In this manner, the liquid component included in the first image is removed through the state in which the first image is in contact with the porous body constituting the image forming surface of the transfer body 101.

The removal of the liquid component is also expressed from a different point of view as concentrating the ink constituting an image (first image) formed on the transfer body 101. Concentrating the ink means that the proportion of a solid component contained in the ink, such as a coloring material and a resin, with respect to the liquid component contained in the ink increases owing to reduction in the liquid component.

Then, movement of the transfer body 101 causes the first image formed on the transfer body 101 to move to a transfer part in which the first image contacts with the recording medium 108 conveyed by a recording medium conveying unit 107. While the image on the transfer body is in contact with the recording medium 108, the transfer pressing member 106 presses the recording medium, thereby transferring an image (ink image) on the recording medium 108.

The removal of the liquid component from the first image is performed at least one of a period before the transfer step (i.e., between the image forming step and the transfer step) and a period in the transfer step. More specifically, in at least one of the period between the image forming step and the transfer step and the period in the transfer step, a liquid absorbing step of absorbing at least some portions of aqueous liquid components constituting the first image by using the porous body of the transfer body from an image (first image) formed in the image forming step is provided. Between the image forming step and the transfer step, the porous body of which transfer body has the image forming surface formed constitutes a liquid absorbing unit. In the transfer step, the pressing member for transfer and the porous body of which transfer body has the image forming surface formed constitute the liquid absorbing unit.

The method for removing the aqueous liquid components from the first image performed between the image forming step and the transfer step and the method for removing the aqueous liquid components from the first image performed in the transfer step will now be described.

In the case of removing the aqueous liquid components from the first image in the period between the image forming step and the transfer step, a method for absorbing the aqueous liquid components by using the porous body constituting the image forming surface of the transfer body is not specifically limited. Examples of this method include a method in which the first image on the transfer body is pressed by a pressing member so that aqueous liquid components are pushed out of the first image and the porous body constituting the image forming surface of the transfer body is impregnated with the aqueous liquid components and a method in which aqueous liquid components are drawn from the first image into the porous body by using a suction unit for sucking the components from the back surface of the porous body which is opposite to the image forming surface.

In the case of removing the aqueous liquid components from the first image in the transfer step, the transfer pressing member 106 serves to constitute a liquid absorbing unit. Specifically, when the pressing member 106 presses the recording medium 108, the first image is also pressed so that the aqueous liquid components are pushed out of the first image. The porous body constituting the image forming surface of the transfer body is impregnated with these aqueous liquid components. In this manner, in the transfer step, the pressing member 106 transfers an image onto the recording medium 108 and removes the aqueous liquid components from the first image.

The ink image transferred onto the recording medium 108 is a reverse image of the second image. In the following description, this transferred ink image will also be referred to as a third image in addition to the first image (ink image before liquid removal) and the second image (ink image after liquid removal).

Since the first image is formed on the transfer body 101 by applying the reaction liquid and then the ink, the reaction liquid that has not reacted with the ink remains on a non-image region (non-ink image region). In this apparatus, the porous body constituting the image forming surface of the transfer body 101 contacts (make pressure contact) not only with the first image but also with an unreacted part of the reaction liquid, and liquid components of the reaction liquid are also removed.

Thus, the expression of removal of the liquid components from the first image in the above description does not strictly mean that the liquid components are removed only from the first image but means that it is sufficient to remove the liquid components at least from the first image on the transfer body 101. For example, liquid components in the reaction liquid applied onto a region outside the first image may be removed together with the liquid components in the first image.

The liquid component is not specifically limited as long as the liquid component does not have unchanged certain shape and has fluidity and a substantially constant volume. Examples of the liquid component include water and an organic solvent included in the ink or the reaction liquid.

In a case where the clear ink is included in the first image, the ink can also be concentrated by a liquid absorbing process. For example, when the color ink is applied onto the clear ink applied on the transfer body 101, the clear ink is present over the entire contact surface of the first image in contact with the transfer body or the clear ink is present on one or more portions of the contact surface of the first image in contact with the transfer body, and the color ink is present on the other portions. In a portion where the clear ink is present under the color ink in the first image, the porous body absorbs liquid components of the clear ink on the contact surface of the first image in contact with the transfer body, and the liquid components of the clear ink moves. Accordingly, liquid components in the color ink moves to the porous body so that aqueous liquid components in the color ink are absorbed.

On the other hand, in a portion where a region of the clear ink and a region of the color ink are present on the contact surface of the first image in contact with the transfer body, liquid components of the color ink and the clear ink move to the porous body so that an aqueous liquid component is absorbed. The clear ink may contain a large amount of a component for enhancing transferability of an image from the transfer body 101 to the recording medium.

A configuration of the transfer type ink jet recording apparatus according to this embodiment will be described below.

Transfer Body

The transfer body 101 includes a surface layer including an image forming surface. The surface layer is made of the water-repellent porous body described above.

Support Member

The transfer body 101 is supported on the support member 102. As a method for supporting the transfer body, various adhesives or a double face tape may be used. The transfer body may be supported on the support member 102 by using an installation member of metal, ceramic, resin and the like attached to the transfer body.

The support member 102 needs to have a structural strength to some degree from the viewpoints of conveyance accuracy and durability. The support member is preferably made of metal, ceramic, resin, or other materials. In particular, to enhance responsiveness of control by reducing an inertia during operation in addition to rigidity against pressurization in transfer and dimensional accuracy, aluminium, iron, stainless, acetal resin, epoxy resin, polyimide, polyethylene, polyethylene terephthalate, nylon, polyurethane, silica ceramic, or alumina ceramic is preferably used. Two or more of these materials are also preferably used in combination.

Reaction Liquid Applying Device

The ink jet recording apparatus according to this embodiment includes a reaction liquid applying device 103 configured to apply a reaction liquid onto the transfer body 101. The reaction liquid applying device 103 illustrated in FIG. 1 is a gravure offset roller including a reaction liquid storage part 103*a* configured to store a reaction liquid and reaction liquid applying members 103*b* and 103*c* configured to apply a reaction liquid in the reaction liquid storage part 103*a* onto the transfer body 101.

Ink Applying Device

The ink jet recording apparatus according to this embodiment includes an ink applying device 104 configured to apply an ink onto the transfer body 101 onto which a reaction liquid is applied. The reaction liquid and the ink are mixed to form a first image, and a liquid component is absorbed from the first image by using the porous body constituting the image forming surface of the transfer body 101.

The temperature in a treatment of absorbing and removing the liquid components from the first image by using the porous body constituting the image forming surface of the transfer body can be set in a range in which an intended liquid absorption effect can be obtained. In a case where the wetting liquid includes a surfactant for adjusting a contact angle, the temperature in forming the first image on the image forming surface constituted by the porous body is preferably controlled to a temperature less than the cloud point of the surfactant contained in the wetting liquid. Since the temperature of the porous body is less than the cloud point of the surfactant in the wetting liquid, an intended contact-angle adjusting function of the surfactant can be more effectively used. The temperature upon contact between the image forming surface constituted by the porous body and the first image in the case where the temperature is less than the cloud point of the surfactant in the wetting liquid is preferably in the range from 5° C. to 60° C.

The temperature control in forming the first image on the image forming surface constituted by the porous body can be performed by disposing a temperature control part including a temperature control unit including a heating unit and, when necessary, a cooling unit, depending on the configuration of the ink jet recording apparatus according to the present invention.

The heating unit and the cooling unit incorporated in the temperature control part are not limited to specific types, and a known heating device or a known cooling device may be used.

For example, an unillustrated heater may be disposed at a position necessary for heating the transfer body 101 in the support member 102 illustrated in FIG. 1, or a chiller for cooling the transfer body may be disposed at a position before formation of the first image. An unillustrated heating roller may contact with the outer periphery of the transfer body 101 illustrated in FIG. 1 to control the temperature, or an infrared ray (IR) heater may be used to control the temperature in a non-contact manner.

Wetting Liquid Applying Device

Before the first image is formed on the image forming surface of the transfer body constituted by the porous body, a pretreatment of the image forming surface of the transfer body in which a wetting liquid is applied by a wetting liquid applying device can be performed.

Figure 3:
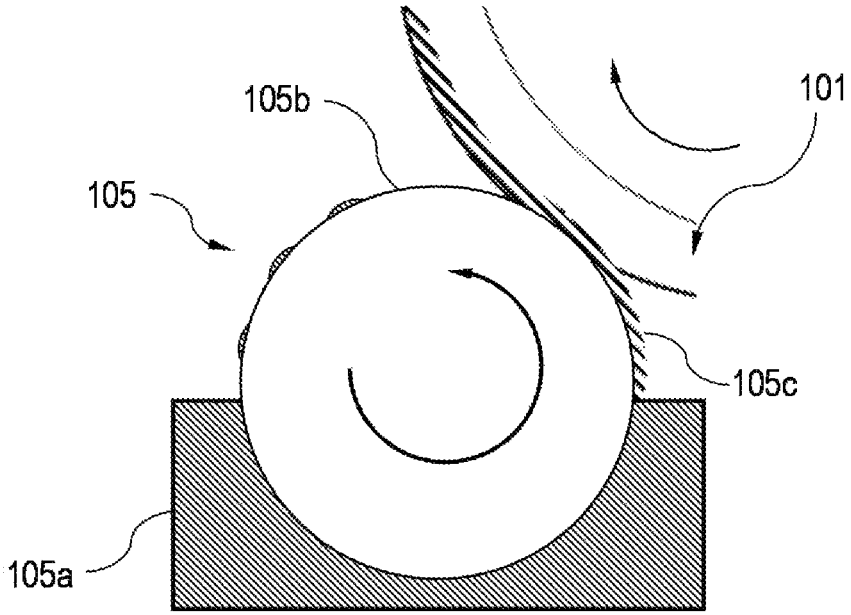
FIG. 3 schematically illustrates a state in which a wetting liquid is applied onto an image forming surface of a transfer body formed of a porous body according to the present invention.

As described above, the method for applying the wetting liquid may be a method such as an immersion method, a coating method, or a liquid dropping method, and is not limited to a specific method. To apply the wetting liquid stably or at high speed in an apparatus, a coating method using roller pressing is preferably used. The wetting liquid applying device in FIG. 1 has a wetting liquid storage part 105*a* which stores the wetting liquid, and the wetting liquid applying member 105*b*, 105*c* for applying the wetting liquid onto the transfer body. FIG. 3 is an enlarged view of the wetting liquid applying device 105 which is a wetting liquid applying device using a pressing roller and applies a wetting liquid to the transfer body 101. The wetting liquid applying device 105 has a configuration in which a wetting liquid stored in a wetting liquid storage part 105*a* is pumped by a wetting liquid applying member 105*b*, 105*c* and is applied, under pressure, onto the image forming surface of the transfer body 101.

As described above, the timing of applying the wetting liquid is not specifically limited. In the case of performing the pretreatment by rotatably driving a drum-shaped or an endless web-shaped transfer body, the timing of applying the wetting liquid may be controlled as appropriate in such a manner that the wetting liquid is applied at each rotation or once in several rotations, for example. A wetting liquid applying device is configured to move up and down by using a motor, a cam mechanism, or an air cylinder so that the wetting liquid applying device can removably contact with the transfer body.

Figure 2:
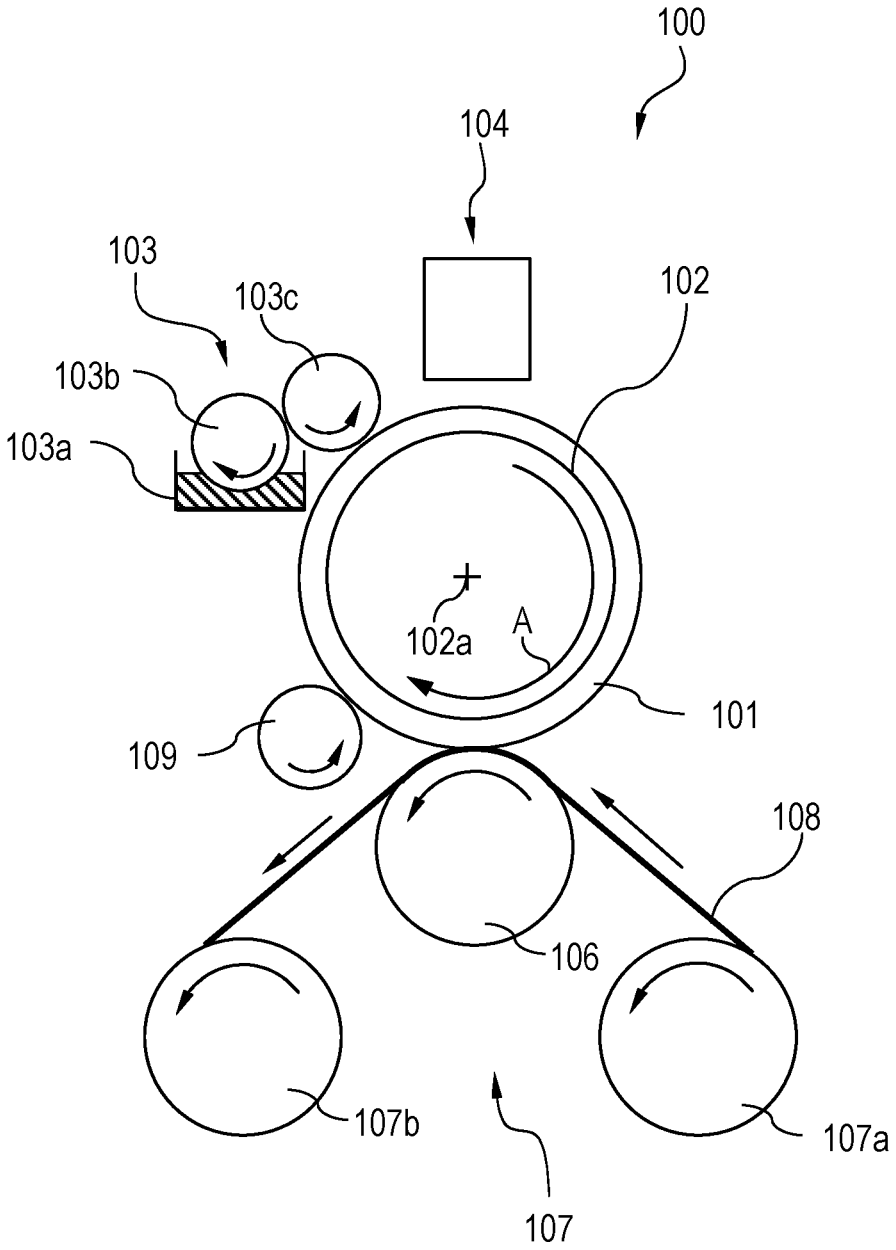
FIG. 2 schematically illustrates an example configuration of a transfer type ink jet recording apparatus according to the present invention including a liquid applying unit serving as both a wetting liquid applying unit and a reaction liquid applying unit.

In the case of preparing the reaction liquid so that the reaction liquid also serves as a wetting liquid, a configuration in which only the reaction liquid applying device 103 is provided as illustrated in FIG. 2 can be employed.

In the embodiment illustrated in FIGS. 1 and 2, before the first image is formed, the wetting liquid applying device 105 or the reaction liquid applying device 103 in a case where the reaction liquid functions also as a wetting liquid can apply a wetting liquid onto the image forming surface of the transfer body 101 made of the porous body as a pretreatment.

The pressure in applying the wetting liquid is not specifically limited, and is preferably 0.1 kgf/cm$^2$ or more because the wetting liquid is applied stably or at high speed in the apparatus in this pressure range. The pressure is preferably 10 kgf/cm$^2$ or less because the structural load on the apparatus can be reduced in this pressure range. In this manner, a second image in which liquid components are absorbed from the first image to reduce the liquid content is formed on the transfer body 101. The second image is next transferred onto the recording medium 108 in the transfer part. An apparatus configuration and requirements in transfer will be described.

Transfer Pressing Member

In the apparatus according to this embodiment, while the second image is in contact with the recording medium 108 being conveyed by the recording medium conveying unit 107, the transfer pressing member 106 presses the recording medium 108 so that an ink is transferred onto the recording medium 108. The transfer onto the recording medium 108 after removal of the liquid component included in the first image on the transfer body 101 can obtain a recorded image in which curling, cockling and the like is reduced.

The pressing member 106 needs to have a structural strength to some degree from the viewpoint of conveyance accuracy or durability of the recording medium 108. The pressing member 106 is preferably made of metal, ceramic, resin, or other materials. In particular, to enhance responsiveness of control by reducing an inertia during operation in addition to rigidity against pressurization in transfer and dimensional accuracy, aluminium, iron, stainless, acetal resin, epoxy resin, polyimide, polyethylene, polyethylene terephthalate, nylon, polyurethane, silica ceramic, or alumina ceramic is preferably used. Two or more of these materials may be used in combination.

The time during which the pressing member 106 presses the recording medium 108 in order to transfer the second image on the transfer body 101 onto the recording medium 108 is not specifically limited, and is preferably 5 ms or more to 100 ms or less in order to perform transfer appropriately and prevent impairing of durability of the transfer body. The time of pressing herein refers to a time during which the recording medium 108 is in contact with the transfer body 101, and is calculated by performing a surface pressure measurement with a surface pressure distribution measuring device (I-SCAN, manufactured by Nitta Corporation) and dividing the length in the conveyance direction of a pressurization region by the conveyance speed.

The pressure with which the pressing member 106 presses the recording medium 108 in order to transfer the second image on the transfer body 101 onto the recording medium 108 is not specifically limited as long as the transfer is appropriately performed and durability of the transfer body is not impaired. To satisfy these requirements, the pressure is preferably 9.8 N/cm$^2$ (1 kg/cm$^2$) or more to 294.2 N/cm$^2$ (30 kg/cm$^2$) or less. The pressure in this embodiment refers to a nip pressure between the recording medium 108 and the transfer body 101, and is calculated by performing a surface pressure measurement with a surface pressure distribution measuring device and dividing the weight in a pressurization region by the area.

The temperature at which the pressing member 106 presses the recording medium 108 in order to transfer the second image on the transfer body 101 onto the recording medium 108 is not specifically limited, and is preferably greater than or equal to a glass transition point or a softening point of a resin component included in the ink, in the case where the ink contains the resin component. Heating is preferably performed with a heating unit configured to heat the second image on the transfer body 101, the transfer body 101, and the recording medium 108.

The pressing member 106 is not limited to a specific shape, and may be a roller shape, for example.

Recording Medium and Recording Medium Conveying Unit

In this embodiment, the recording medium 108 is not specifically limited, and any known recording medium may be used. Examples of the recording medium include a rolled long medium and a cut-sheet medium cut into a predetermined size. Examples of a material for the recording medium include paper, a plastic film, a wooden board, a corrugated cardboard, and a metal film.

In FIG. 1, the recording medium conveying unit 107 for conveying the recording medium 108 includes a recording medium feeding roller 107*a* and a recording medium winding roller 107*b*.

Control System

Figure 4:
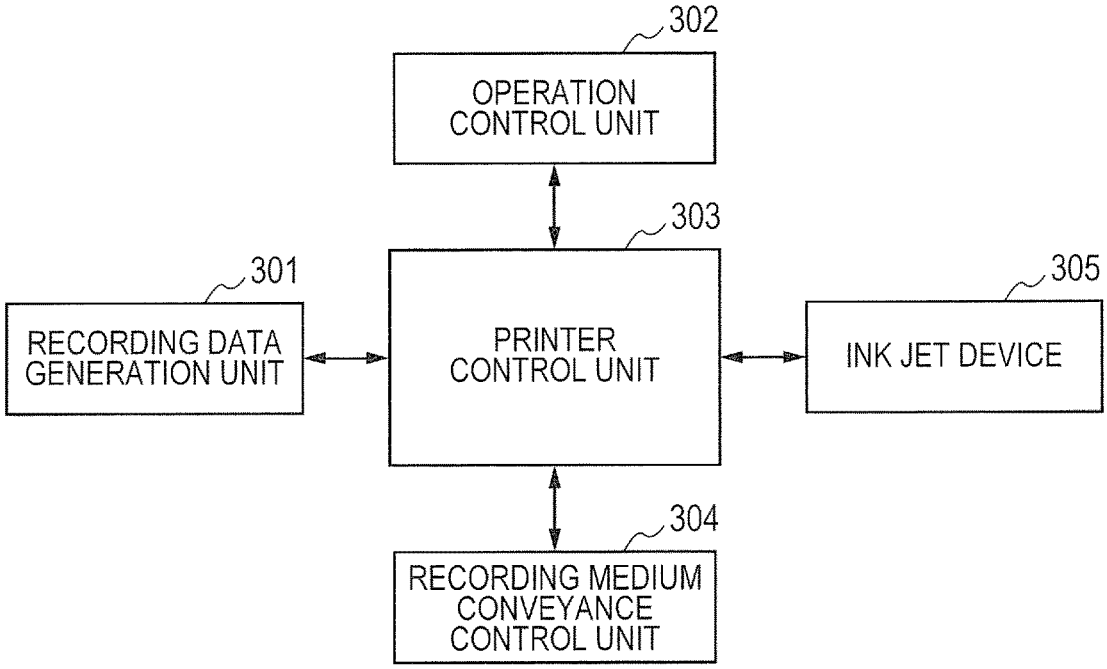
FIG. 4 is a block diagram illustrating a control system of the entire ink jet recording apparatus illustrated in FIGS. 1 and 2.

The transfer type ink jet recording apparatus according to this embodiment includes a control system that controls devices. FIG. 4 is a block diagram illustrating a control system of the entire transfer type ink jet recording apparatus illustrated in FIG. 1.

In FIG. 4, reference numeral 301 denotes a recording data generating unit such as an external print server, reference numeral 302 denotes an operation control unit such as an operation panel, reference numeral 303 denotes a printer control unit to perform a recording process, reference numeral 304 denotes a recording medium conveyance control unit to convey a recording medium, and reference numeral 305 denotes an ink jet device to perform printing.

Figure 5:
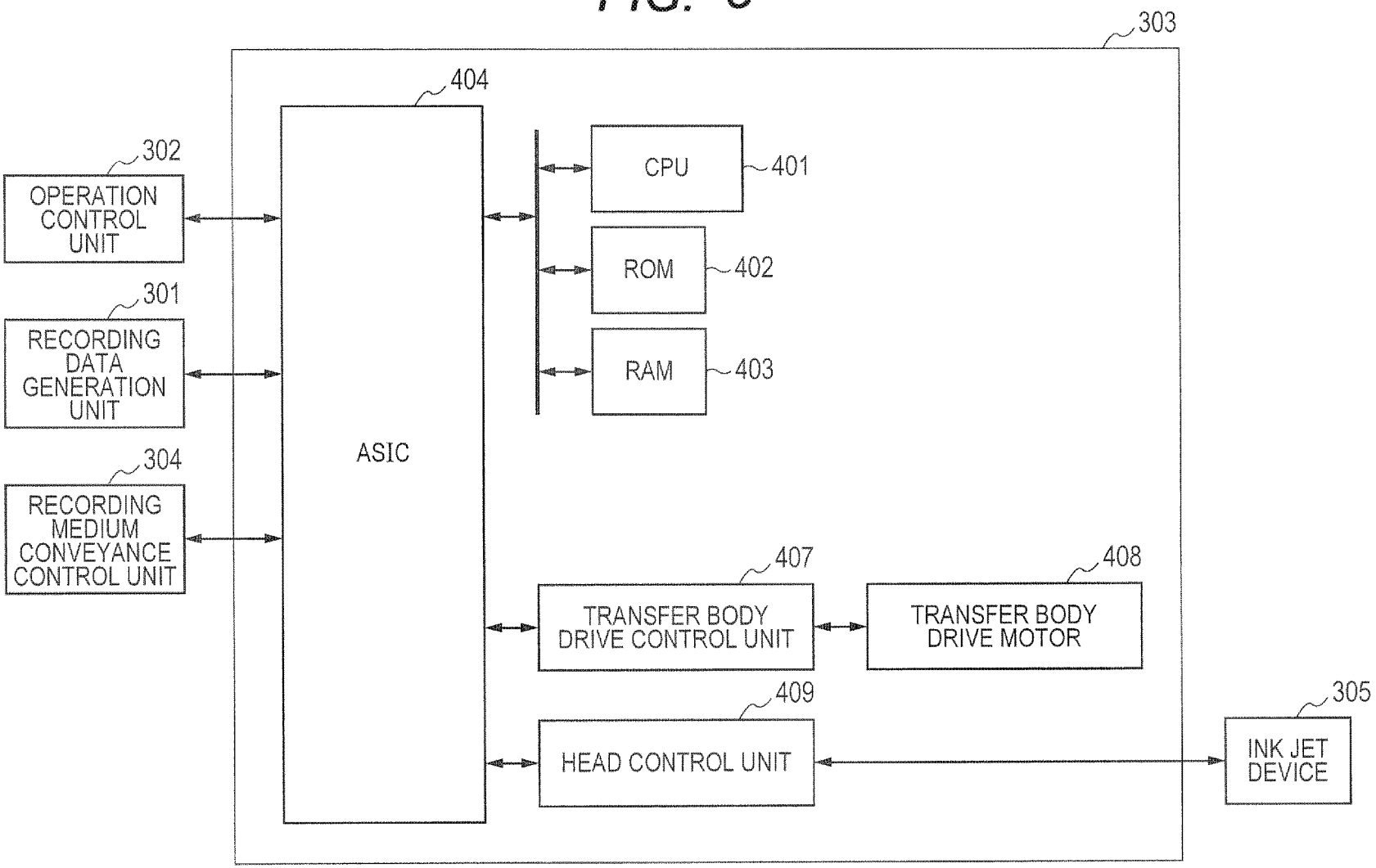
FIG. 5 is a block diagram of a printer control unit in the transfer type ink jet recording apparatus illustrated in FIG. 1.

FIG. 5 is a block diagram of a printer control unit in the transfer type ink jet recording apparatus illustrated in FIG. 1.

Reference numeral 401 denotes a CPU for controlling the entire printer, reference numeral 402 denotes a ROM for storing a control program of the CPU, and reference numeral 403 denotes a RAM for executing a program. Reference numeral 404 denotes an application specific integrated circuit (ASIC) incorporating a network controller, a serial IF controller, a head data generating controller, a motor controller, etc. Reference numeral 407 denotes a transfer body drive control unit for driving a transfer body drive motor 408, and is subjected to command control by the ASIC 404 through the serial IF similarly. Reference numeral 409 denotes a head control unit configured to perform generation of final discharge data of the ink jet device 305, generation of a driving voltage, etc.

Method For Removing Liquid From Transfer Body

Liquid components absorbed in the porous body of the transfer body can be removed from the transfer body 101 by a known method. Examples of the method include a method using heating, a method of sending low-humidity air, a method of reducing pressure, and a method of squeezing the porous body.

In an aspect of the present invention, a transfer type ink jet recording method and a transfer type ink jet recording apparatus which can increase an efficiency in absorbing liquid components to a transfer body in absorbing from the transfer body side the liquid components from an image formed on an image forming surface of the transfer body and can enhance releasability of a coloring material from the image forming surface of the transfer body.

EXAMPLES

The present invention will now be more specifically described with reference to examples and comparative examples. The present invention is not limited to the following examples, unless exceeding the gist thereof. In the following description of the examples, "part(s)" is based on mass unless otherwise specified.

Example 1

In this example, the transfer type ink jet recording apparatus illustrated in FIG. 1 was used.

The wetting liquid was applied from the wetting liquid applying device 105 onto the porous transfer body 101. Thereafter, the reaction liquid was applied from the reaction liquid applying device 103 onto the porous transfer body 101. And the ink was applied from the ink applying device 104 onto the porous transfer body which the wetting liquid and the reaction liquid were applied onto. The wetting liquid applying device 105 and the reaction liquid applying device 103 were each a gravure offset roller. The ink applying device 104 was an ink jet head of a type that used an electrothermal converter and discharged an ink in an on-demand manner, and the ink application amount was 20 $g/m^2$. To adjust the conveyance speed substantially equal to the travelling speed of the transfer body 101, the recording medium 108 was conveyed by the recording medium feeding roller 107*a* and the recording medium winding roller 107*b*. In this example, the conveyance speed was 0.2 m/s. As the recording medium 108, Aurora Coat (manufactured by Nippon Paper Industries Co., Ltd. with a basis weight of 104 $g/m^2$) was used.

The transfer pressing member 106 pressed the recording medium 108 so that the transfer nip pressure between the transfer body 101 and the recording medium 108 was 5 $kg/cm^2$ on average. The pressing by the pressing member 106 upon transfer caused the porous body of the transfer body to absorb aqueous liquid components so that the aqueous liquid components were removed from an image on the transfer body.

In this example, porous PTFE film having an average pore diameter of 0.2 μm was used for the porous transfer body. The contact angle for the surface of this porous PTFE film with water was 118°.

The reaction liquid applied by the reaction liquid applying device 103 had the composition below. The amount of application of the reaction liquid was 1 $g/m^2$.

| | |
|---|---|
| Glutaric acid | 21.0 parts |
| Glycerine | 5.0 parts |
| Surfactant (trade name: Megafac F444, manufactured by DIC Corporation) | 5.0 parts |
| Ion-exchanged water | balance |

The ink was prepared in the following manner.

Preparation of Pigment Dispersion

First, 10 parts of carbon black (trade name: MONARCH 1100, manufactured by Cabot Corporation), 15 parts of a resin aqueous solution (a solution of a styrene-ethyl acrylate-acrylic acid terpolymer having an acid value of 150, a weight-average molecular weight (Mw) of 8,000, and a resin content of 20.0 mass % neutralized with a potassium hydroxide aqueous solution), and 75 parts of pure water were mixed. This mixture was fed in a batch type vertical sand mill (manufactured by AIMEX Co., Ltd.), and the mill was charged with 200 parts of zirconia beads having a diameter of 0.3 mm. These material were dispersed for five hours while being cooled with water. Then, this dispersion liquid was centrifugalized so that coarse particles were removed, and then, a black pigment dispersion having a pigment content of 10.0 mass % was obtained.

Preparation of Resin Particle Dispersion

First, 20 parts of ethyl methacrylate, 3 parts of 2,2'-azobis-(2-methylbutyronitrile), and 2 parts of n-hexadecane were mixed, and the mixture was stirred for 0.5 hours. This mixture was dropped to 75 parts of an 8 mass % aqueous solution of a styrene-butyl acrylate-acrylic acid copolymer (having an acid value of 130 mgKOH/g, a weight-average molecular weight (Mw) of 7,000), followed by stirring for 0.5 hours. Then, the resulting mixture was subjected to supersonic wave irradiation for 3 hours with a supersonic wave irradiator. Subsequently, the mixture was subjected to a polymerization reaction for 4 hours in a nitrogen atmosphere at 80° C., followed by cooling to room temperature.

The reaction product was then filtered to yield a resin particle dispersion with a resin content of 25.0 mass %.

Preparation of Ink

The resin particle dispersion obtained above and the pigment dispersion were mixed with the components below. The indication "balance" for ion-exchanged water refers to an amount with which the sum of all the components constituting the ink is 100.0 mass %.

| | |
|---|---|
| Pigment dispersion (with a coloring material content of 10.0 mass %) | 40.0 mass % |
| Resin fine particle dispersion | 20.0 mass % |
| Glycerine | 7.0 mass % |
| Polyethylene glycol (having a number-average molecular weight (Mn) of 1,000) | 3.0 mass % |
| Surfactant Acetylenol E100 (trade name, manufactured by Kawaken Fine Chemicals Co., Ltd.) | 0.5 mass % |
| Ion-exchanged water | balance |

These materials were sufficiently stirred to be dispersed, and then subjected to pressure filtration through a microfilter having a pore size of 3.0 μm (manufactured by Fujifilm Corporation), thereby preparing a black ink.

The ink applying device 104 used an ink jet head of such a type as to discharge an ink in an on-demand manner with an electrothermal converter. The amount of the ink applied in image formation was 20 g/m$^2$.

As a wetting liquid to be applied to the porous transfer body 101, a liquid having the composition below was used. The liquid application amount was 10 g/m$^2$.

| | |
|---|---|
| Glycerine | 10.0 mass % |
| Surfactant (trade name: Megafac F444, manufactured by DIC Corporation) | 5.0 mass % |
| Ion-exchanged water | balance mass % |

Example 2

Image formation and evaluation of the formed image were performed in a manner similar to that in Example 1 except that the fluorine-based surfactant Megafac F444 (trade name, manufactured by DIC Corporation) was replaced by Capstone FS-3100 (trade name, manufactured by The Chemours Company LLC) as the surfactant contained in the wetting liquid.

Example 3

Image formation and evaluation of the formed image were performed in a manner similar to that in Example 1 except that the fluorine-based surfactant Megafac F444 (trade name, manufactured by DIC Corporation) was replaced by a silicone-based surfactant BYK349 (trade name, manufactured by BYK Japan KK) as the surfactant contained in the wetting liquid.

Example 4

Image formation and evaluation of the formed image were performed in a manner similar to that in Example 1 except that the pressure applied in applying the wetting liquid was set at 0 kg/cm$^2$ by changing the application method of the wetting liquid to a dropping method.

In this example, since the wetting liquid was applied by immersion under no pressure, a negligible slight smeared image occurred at the first use. After pressing contact between an image and the porous transfer body, however, the porous body uniformly became wet with a liquid component of the ink so that such a smeared image was not observed after subsequent repetitive use.

Example 5

Image formation and evaluation of the formed image were performed in a manner similar to that in Example 4 except that the surfactant in the ink was changed from Acetylenol E100 (trade name, manufactured by Kawaken Fine Chemicals Co., Ltd.) to F-444 (trade name, manufactured by DIC Corporation).

Example 6

Image formation and evaluation of the formed image were performed in a manner similar to that in Example 1 except that the temperature of the porous transfer body was changed.

Example 7

Image formation and evaluation of the formed image were performed in a manner similar to that in Example 2 except that the temperature of the porous body was changed as indicated in Table 1-1.

Example 8

Image formation and evaluation of the formed image were performed in a manner similar to that in Example 3 except that the temperature of the porous body was changed as indicated in Table 1-1.

Example 9

Image formation and evaluation of the formed image were performed in a manner similar to that in Example 1 except that a porous body of PTFE was immersed in Optool HD-1100TH (manufactured by DAIKIN INDUSTRIES, LTD) and was subjected to a surface treatment so that the contact angle of water with respect to a first surface of the porous body was reduced.

Example 10

Image formation and evaluation of the formed image were performed in a manner similar to that in Example 1 except that a porous body of PTFE was immersed in Optool DS-TH (manufactured by DAIKIN INDUSTRIES, LTD) and was subjected to a surface treatment so that the contact angle of water with respect to a first surface of the porous body was reduced.

Comparative Example 1

Image formation and evaluation of the formed image were performed in a manner similar to that in Example 1 except that no wetting liquid was applied to the porous body.

Comparative Example 2

The surfactant contained in the wetting liquid was changed from F-444 (trade name, manufactured by DIC Corporation) to Acetylenol E100 (trade name, manufactured by Kawaken Fine Chemicals Co., Ltd.) so that the contact angle of the wetting liquid with respect to the image forming surface of the porous body was adjusted to 90° or more. In the other aspects, image formation and evaluation of the formed image were performed in the same manner as that in Example 1.

Comparative Example 3

Image formation and evaluation of the formed image were performed in a manner similar to Comparative Example 2 except that the temperature of the porous body was changed as indicated in Table 1-2.

Comparative Example 4

Image formation and evaluation of the formed image were performed in a manner similar to that in Example 1 except that hydrophilic PTFE film obtained by performing a treatment on the porous PTFE film used in Example 1 with polyvinyl alcohol (PVA) was used as the porous body.

Comparative Example 5

Image formation and evaluation of the formed image were performed in a manner similar to that in Example 1 except that hydrophilic PTFE film obtained by performing a treatment on the porous PTFE film used in Example 1 with polyvinyl alcohol (PVA) was used as the porous body and no wetting liquid was applied.

Evaluation

Evaluations for examples and comparative examples were conducted by the following methods. Tables 1-1 and 1-2 show evaluation results. In the present invention, evaluation criteria A and B are defined as preferred levels and criterion C is defined as an unacceptable level in evaluation items below.

Transferability

With a plane spectrometer (PSA-700E, manufactured by JFE Techno-Research Corporation), three optical densities of "A" which is an optical density (O.D.) of an image formed on the transfer body, "B" which is an optical density (O.D.) of an image remaining on the transfer body after transfer, and "C" which is an optical density (O.D.) of an image on the transfer body before transfer were measured and used to define, as a transfer rate, a value calculated from Equation 1 below. Based on the transfer rate, transferability was evaluated.

$$\text{transfer rate (\%)}=((A-B)/(A-C))\times 100 \qquad \text{Equation 1:}$$

Evaluation criteria are as follows:

A: The transfer rate is 95% or more.

B: The transfer rate is 80% or more to less than 95%.

C: The transfer rate is less than 80%.

Smeared Image

A smeared image in an image on a recording medium after the image has been transferred onto the recording medium on the conditions described above was evaluated based on criteria below. The smeared image refers to a phenomenon that a coloring material in the image in an end portion thereof unintentionally moves because of pressing of the recording medium against the transfer body by using the transfer pressing member. The amount of movement of the coloring material is preferably as small as possible because image quality increases as the amount of movement of the coloring material decreases. Evaluation criteria are as follows:

A: No smeared image was observed after repetitive use.

B: A slight smeared image was observed after a single use but at a negligible level.

C: A significantly smeared image was observed after a single use.

TABLE 1

| | Material of porous transfer body | Contact angle for image forming surface of transfer body with water | Surfactant in wetting liquid | Cloud point of surfactant in wetting liquid | Contact angle for image forming surface of transfer body with wetting liquid | Pressure to apply wetting liquid (kg/cm$^2$) | Surface temperature of transfer body | Surfactant in ink | Smeared image | Transferability |
|---|---|---|---|---|---|---|---|---|---|---|
| Example 1 | PTFE | 118° | F-444 | 80° C. | 85° | 1 | 30° C. | Acetylenol E100 | A | A |
| Example 2 | PTFE | 118° | FS3100 | 65° C. | 85° | 1 | 30° C. | Acetylenol E100 | A | A |
| Example 3 | PTFE | 118° | BYK349 | 49° C. | 88° | 1 | 30° C. | Acetylenol E100 | A | A |
| Example 4 | PTFE | 118° | F-444 | 80° C. | 85° | 0 | 30° C. | Acetylenol E100 | B | B |
| Example 5 | PTFE | 118° | F-444 | 80° C. | 85° | 0 | 30° C. | F-444 | A | B |
| Example 6 | PTFE | 118° | F-444 | 80° C. | 85° | 1 | 85° C. | Acetylenol E100 | B | B |
| Example 7 | PTFE | 118° | FS3100 | 65° C. | 85° | 1 | 70° C. | Acetylenol E100 | B | B |
| Example 8 | PTFE | 118° | BYK349 | 49° C. | 88° | 1 | 55° C. | Acetylenol E100 | B | B |
| Example 9 | PTFE (surface treated) | 111° | F-444 | 80° C. | 82° | 1 | 30° C. | Acetylenol E100 | A | A |
| Example 10 | PTFE (surface treated) | 93° | F-444 | 80° C. | 81° | 1 | 30° C. | Acetylenol E100 | A | A |

TABLE 1-continued

| | Material of porous transfer body | Contact angle for image forming surface of transfer body with water | Surfactant in wetting liquid | Cloud point of surfactant in wetting liquid | Contact angle for image forming surface of transfer body with wetting liquid | Pressure to apply wetting liquid (kg/cm$^2$) | Surface temperature of transfer body | Surfactant in ink | Smeared image | Transferability |
|---|---|---|---|---|---|---|---|---|---|---|
| Comparative Example 1 | PTFE | 118° | | no wetting liquid | | | 30° C. | Acetylenol E100 | C | — (Impossible to evaluate because of smeared image) |
| Comparative Example 2 | PTFE | 118° | Acetylenol E100 | 49° C. | 93° | 1 | 30° C. | Acetylenol E100 | C | — (Impossible to evaluate because of smeared image) |
| Comparative Example 3 | PTFE | 118° | Acetylenol E100 | 49° C. | 93° | 1 | 55° C. | Acetylenol E100 | C | — (Impossible to evaluate because of smeared image) |
| Comparative Example 4 | hydrophilized PTFE | 40° | F-444 | 80° C. | 38° | 1 | 30° C. | Acetylenol E100 | A | C |
| Comparative Example 5 | hydrophilized PTFE | 40° | | no wetting liquid | | | 30° C. | Acetylenol E100 | A | C |

TABLE 1-2

| | Material of porous transfer body | Contact angle for image forming surface of transfer body with water | Surfactant in wetting liquid | Cloud point of surfactant in wetting liquid | Contact angle for image forming surface of transfer body with wetting liquid | Pressure to apply wetting liquid (kg/cm$^2$) | Surface temperature of transfer body | Surfactant in ink | Smeared image | Transferability |
|---|---|---|---|---|---|---|---|---|---|---|
| Comparative Example 1 | PTFE | 118° | | no wetting liquid | | | 30° C. | Acetylenol E100 | C | (Impossible to evaluate because of smeared image) |
| Comparative Example 2 | PTFE | 118° | Acetylenol E100 | 49° C. | 93° | 1 | 30° C. | Acetylenol E100 | C | (Impossible to evaluate because of smeared image) |
| Comparative Example 3 | PTFE | 118° | Acetylenol E100 | 49° C. | 93° | 1 | 55° C. | Acetylenol E100 | C | (Impossible to evaluate because of smeared image) |
| Comparative Example 4 | hydrophilized PTFE | 40° | F-444 | 80° C. | 38° | 1 | 30° C. | Acetylenol E100 | A | C |
| Comparative Example 5 | hydrophilized PTFE | 40° | | no wetting liquid | | | 30° C. | Acetylenol E100 | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-026412, filed Feb. 15, 2016, which is hereby incorporated by reference herein in its entirety.

What is claimed is:

1. A transfer type ink jet recording method comprising:

an image forming step of forming an image including an aqueous liquid component and a coloring material on an image forming surface of a transfer body, the image forming surface being formed of a water-repellent porous body;

a transfer step of transferring the image from the transfer body onto a recording medium;

a wetting treatment step of performing a wetting treatment by applying a wetting liquid, whose contact angle with respect to the image forming surface is less than 90°, onto the image forming surface before the image forming step; and a liquid absorbing step of absorbing at least a part of the aqueous liquid component from the image formed in the image forming step to the transfer body by using the porous body, in at least one of (i) a period between the image forming step and the transfer step and (ii) a period in the transfer step.

2. The transfer type ink jet recording method according to claim 1, wherein the image forming step includes the steps of:

applying a first liquid composition containing an ink-viscosity-increasing component onto the transfer body, and applying a second liquid composition containing an aqueous liquid medium and a coloring material onto the transfer body.

3. The transfer type ink jet recording method according to claim 2, wherein the image forming step includes the steps of:

applying the first liquid composition onto the transfer body, and applying the second liquid composition onto the transfer body so that the second liquid composition overlaps with at least a region on which the first liquid composition is applied.

4. The transfer type ink jet recording method according to claim 2, wherein the first liquid composition includes an aqueous liquid component that functions as the wetting liquid.

5. The transfer type ink jet recording method according to claim 1, wherein the coloring material includes a pigment.

6. The transfer type ink jet recording method according to claim 1, wherein the wetting liquid contains water and a surfactant.

7. The transfer type ink jet recording method according to claim 6, wherein the surfactant comprises one of a silicone-based surfactant and a fluorine-based surfactant.

8. The transfer type ink jet recording method according to claim 6, wherein a temperature in image formation on the image forming surface is controlled to a temperature less than a cloud point of the surfactant.

9. The transfer type ink jet recording method according to claim 1, wherein a contact angle for the image forming surface with water is 90° or more.

10. The transfer type ink jet recording method according to claim 1, wherein the porous body includes a water-repellent resin including polytetrafluoroethylene.

11. The transfer type ink jet recording method according to claim 1, wherein an image forming surface for performing the image forming step and a transfer region for performing the transfer step are provided, wherein the transfer body is caused to relatively move with respect to the image forming surface and the transfer region, and wherein the transfer region is disposed downstream of the image forming surface in a direction in which the transfer body moves.

12. A transfer type ink jet recording apparatus comprising:

a transfer body having an image forming surface formed of a water-repellent porous body;

an image forming unit configured to form an image including an aqueous liquid component and a coloring material on the image forming surface;

a transfer unit configured to transfer the image from the transfer body onto a recording medium;

a wetting liquid applying unit configured to perform a wetting treatment by applying a wetting liquid, whose contact angle with respect to the image forming surface is less than 90°, onto the image forming surface;

a conveyance unit configured to relatively move the transfer body with respect to the wetting liquid applying unit, the image forming unit, and the transfer unit in this order; and a liquid absorbing unit configured to absorb at least a part of the aqueous liquid component from an image formed by the image forming unit to the transfer body by using the porous body.

13. The transfer type ink jet recording apparatus according to claim 12, wherein the image forming unit includes:

a first liquid applying unit configured to apply a first liquid composition containing an ink-viscosity-increasing component onto the transfer body, and a second liquid applying unit configured to apply a second liquid composition containing an aqueous liquid medium and a coloring material onto the transfer body.

14. The transfer type ink jet recording apparatus according to claim 13, wherein the first liquid composition includes an aqueous liquid component that functions as the wetting liquid.

15. The transfer type ink jet recording apparatus according to claim 12, wherein the coloring material includes a pigment.

16. The transfer type ink jet recording apparatus according to claim 12, wherein the wetting liquid contains water and a surfactant.

17. The transfer type ink jet recording apparatus according to claim 16, wherein the surfactant comprises one of a silicone-based surfactant and a fluorine-based surfactant.

18. The transfer type ink jet recording apparatus according to claim 16, wherein a temperature in image formation on the image forming surface is controlled to a temperature less than a cloud point of the surfactant.

19. The transfer type ink jet recording apparatus according to claim 12, wherein a contact angle for the image forming surface with water is 90° or more.

20. The transfer type ink jet recording apparatus according to claim 12, wherein the image forming surface includes a water-repellent resin including polytetrafluoroethylene.

21. The transfer type ink jet recording apparatus according to claim 12, wherein the transfer body is caused to move relative to the image forming unit and the transfer unit, and wherein the transfer unit is disposed downstream of the image forming unit in a direction in which the transfer body moves.

22. A transfer type ink jet recording method comprising:

an image forming step of forming an image including an aqueous liquid component and a coloring material on an image forming surface of a transfer body, the image forming surface being formed of a water-repellent porous body;

a transfer step of transferring the image from the transfer body onto a recording medium;

a wetting treatment step of performing a wetting treatment by applying a wetting liquid, whose contact angle with respect to the image forming surface is less than 90°, onto the image forming surface before the image forming step; and a liquid absorbing step of absorbing at least a part of the aqueous liquid component from an image formed in the image forming step to the transfer body by using the porous body, in at least one of (i) a period between the image forming step and the transfer step and (ii) a period in the transfer step.

23. A transfer type ink jet recording apparatus comprising:

a transfer body having an image forming surface formed of a water-repellent porous body;

an image forming unit configured to form an image including an aqueous liquid component and a coloring material on the image forming surface;

a transfer unit configured to transfer the image from the transfer body onto a recording medium;

a wetting liquid applying unit configured to perform a wetting treatment by applying a wetting liquid, whose contact angle with respect to the image forming surface is less than 90°, onto the image forming surface;

a conveyance unit configured to move the transfer body relative to the wetting liquid applying unit, the image forming unit, and the transfer unit in this order; and a liquid absorbing unit configured to absorb at least a part of the aqueous liquid component to the transfer body by using the porous body from an image formed by the image forming unit, so that an ink constituting the image is concentrated.

* * * * *